US007717806B2

(12) United States Patent
Kubota

(10) Patent No.: US 7,717,806 B2
(45) Date of Patent: May 18, 2010

(54) PUTTER HEAD

(75) Inventor: Makoto Kubota, Kawaguchi (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 2 days.

(21) Appl. No.: 12/400,469

(22) Filed: Mar. 9, 2009

(65) Prior Publication Data

US 2009/0170631 A1 Jul. 2, 2009

Related U.S. Application Data

(63) Continuation of application No. 11/474,295, filed on Jun. 26, 2006.

(30) Foreign Application Priority Data

Dec. 27, 2005 (JP) ..... 2005-375800

(51) Int. Cl.
*A63B 53/04* (2006.01)

(52) U.S. Cl. ..... 473/340; 473/345

(58) Field of Classification Search ..... 473/324–350
See application file for complete search history.

(56) References Cited

U.S. PATENT DOCUMENTS

| | | | | |
|---|---|---|---|---|
| 4,754,976 | A | 7/1988 | Pelz | |
| 4,834,387 | A | 5/1989 | Waites et al. | |
| 5,211,401 | A | 5/1993 | Hainey | |
| 5,320,353 | A | 6/1994 | Moore | |
| 5,324,031 | A | 6/1994 | Green | |
| 5,482,281 | A | 1/1996 | Anderson | |
| 6,095,931 | A | 8/2000 | Hettinger et al. | |
| 6,471,600 | B2 | 10/2002 | Tang et al. | |
| 7,004,849 | B2 | 2/2006 | Cameron | |
| 7,048,646 | B2 | 5/2006 | Yamanaka et al. | |
| 7,108,614 | B2 | 9/2006 | Lo | |
| 7,351,162 | B2 | 4/2008 | Soracco et al. | |
| 7,354,356 | B2 | 4/2008 | Yamanaka et al. | |
| 2006/0019766 | A1 * | 1/2006 | Kubota | 473/340 |
| 2006/0217216 | A1 | 9/2006 | Iizuka | |
| 2007/0007261 | A1 * | 1/2007 | Hou | 219/121.64 |

FOREIGN PATENT DOCUMENTS

| | | | |
|---|---|---|---|
| JP | 11-057085 | A | 3/1999 |
| JP | 11-114112 | A | 4/1999 |
| JP | 2001-231898 | A | 8/2001 |
| JP | 2002-224253 | A | 8/2002 |
| JP | 2002-533180 | A | 10/2002 |
| JP | 2004-290565 | A | 10/2004 |
| JP | 2005-046442 | A | 2/2005 |
| JP | 2005-066249 | A | 3/2005 |
| JP | 2005-124806 | A | 5/2005 |
| JP | 2007-215714 | A | 8/2007 |

* cited by examiner

*Primary Examiner*—Alvin A Hunter
(74) *Attorney, Agent, or Firm*—Sughrue Mion, PLLC

(57) ABSTRACT

A putter head wherein a depth of a center of gravity, ZGR, is a value greater than half of a head width W, namely, ZGR≧W/2, and that a moment of inertia, IY, about the center of gravity is such that IY≧4000 g·cm$^2$.

13 Claims, 3 Drawing Sheets

PUTTER HEAD

This application is a Continuation Application of U.S. application Ser. No. 11/474,295, filed Jun. 26, 2006, which claims priority from Japanese Application No. 2005-375800, filed Dec. 27, 2005, the entire disclosures of which are incorporated herein.

BACKGROUND OF THE INVENTION

1. Field of the Invention

The present invention relates to a putter head for golf.

2. Description of the Related Art

In putting, the path of a club head in a putting stroke is important, and the orientation of the face surface at the time of impact as well as the position of an impact point (a point of contact between the face surface and the ball at the time of impact) are very important. Putting is hitting a ball by aiming at a small cup on a green, which has complicated inclinations, and if there is any error in the ball hitting direction or the hitting speed, the ball misses the small cup. This is because the trajectory of the ball rolling on the green subtly changes depending on the initial speed of the ball and the hitting direction and further on the green speed, the inclination, and the like. Accordingly, to obtain an excellent result inputting, it is necessary to control the hitting direction and the hitting speed very accurately. For this purpose, it becomes necessary to stabilize the path of the head during the stroke and to very accurately control the orientation of the face surface and the position of the impact point at the time of impact.

To attain the above-described object, a putter head came to be proposed in which three kinds of moment of inertia in the putter head are appropriately set by giving consideration to the characteristic features of the head behavior based on the characteristics of the putting stroke, thereby making it possible to stabilize the path of the head and stabilize the orientation of the face surface and the position of the impact point at the time of impact. In this putter head, it is assumed that the moment of inertia of a first axis that passes through the center of gravity of the head and is parallel to the face surface and a horizontal plane is M1. Also, it is assumed that the moment of inertia of the head about a second axis that is a vertical axis passing though the center of gravity of the head is M2. Further, it is assumed that the moment of inertia of the head about a third axis that passes through the center of gravity of the head and is orthogonal to the first axis and to the second axis is M3. A weight balance is set such that a relationship of M2>M3>M1 is satisfied, and that a value of (M3−M1) is not less than 50 g·cm$^2$ and not more than 1500 g·cm$^2$ (refer to JP-A-2005-124806 (page 6, FIG. 1)).

SUMMARY OF THE INVENTION

In the conventional technique, attention is paid to three moments of inertia to stabilize the path of the head particularly in a short putt and stabilize the orientation of the face surface and the position of the impact point at the time of impact, and the setting of these numerical values and relationships among these respective parameters are specified. However, since attention is not paid to the relationship between the depth of the center of gravity and the width of the head and to their relationship and the moment of inertia (the aforementioned M2) about the center of gravity, the putter head is not easy for an amateur golfer to handle, and it could not be said that rolling is excellent.

An aspect of the invention provides a putter head that is easy to handle and stabilizes the rolling distance, in which variations in the rolling distance are small, and which is optimally suited to an amateur golfer.

According to an aspect of the invention, there is provided a putter head constructed so that a depth of a center of gravity, ZGR, is a value greater than half of a head width W, namely, ZGR≧W/2, and that a moment of inertia, IY, about the center of gravity is such that IY≧4000 g·cm$^2$.

According to the aspect of the invention, the putter head is constructed so that the depth of the center of gravity, ZGR, is a value greater than half of the head width W, namely, ZGR≧W/2, and the moment of inertia, IY, about the center of gravity is such that IY≧4000 g cm$^2$, preferably 4200 to 5000 g·cm$^2$. As a result, the center of gravity becomes deep. Therefore, the position of the center of gravity on the face surface becomes high, and the ball immediately starts to roll without being hit upward at the time of impact, so that the rolling distance stabilizes. In addition, since the moment of inertia about the center of gravity is made large, even if the impact point is slightly offset, variations in the rolling distance are small.

In addition, in a putter head having in combination a face member, an intermediate member, and a back member, wherein a relationship in specific gravity among the respective members is such that the specific gravity of the intermediate member<the specific gravity of the face member≦the specific gravity of the back member, the moment of inertia of the head can be increased, and the sweet area can be enlarged, so that the putter head becomes easy even for an amateur golfer to handle.

DETAILED DESCRIPTION OF THE PREFERRED EMBODIMENTS

Figure 1:
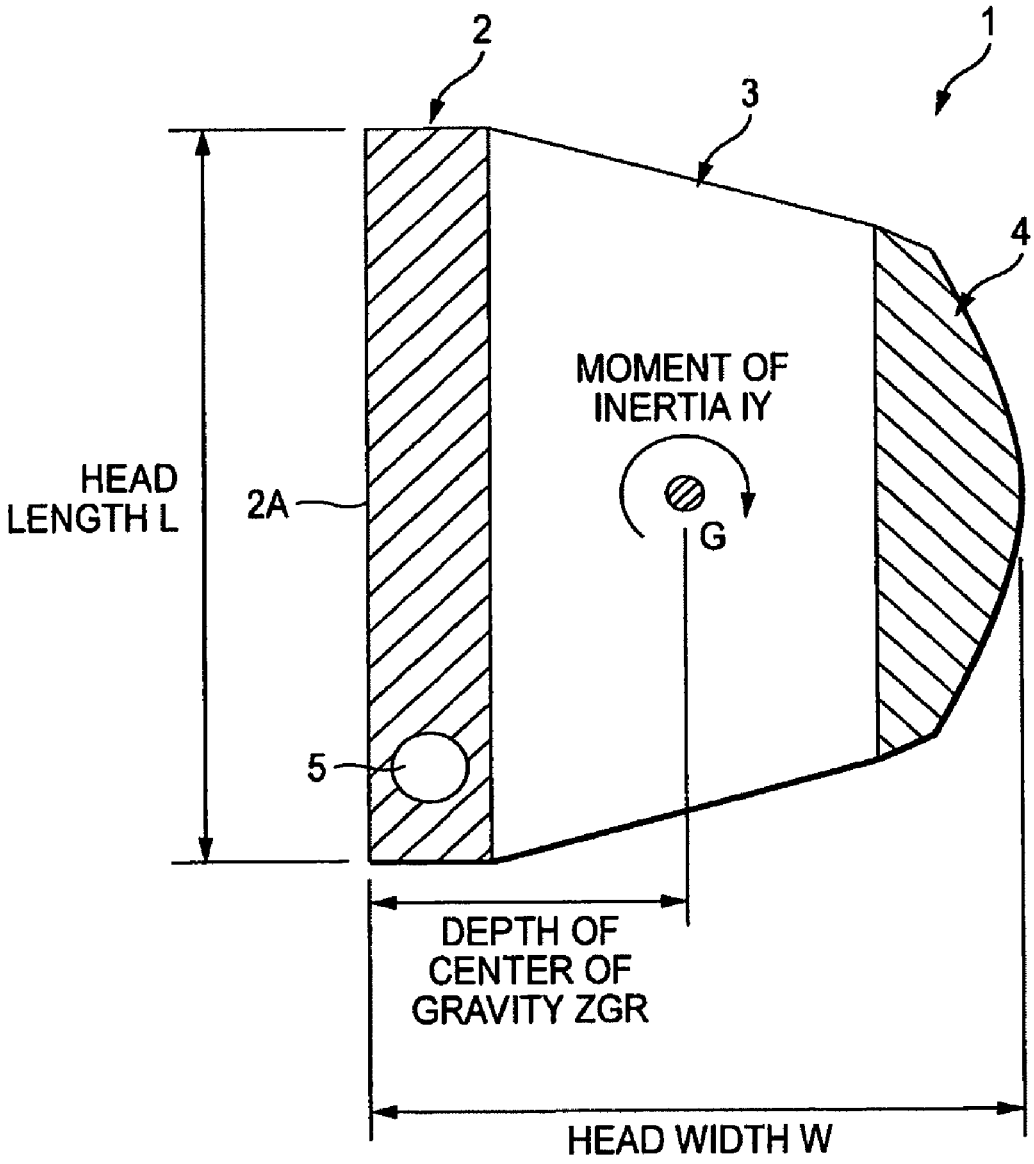
FIG. 1 is a plan view illustrating an embodiment of the invention.

In an embodiment shown in FIG. 1, a putter head 1 is constructed by combining a face member 2, an intermediate member 3, and a back member 4. The face member 2 is formed of a metal material such as an aluminum alloy (specific gravity: 2.7) or stainless steel (specific gravity: 7.8). The intermediate member 3 is formed of a resin material, FRP, or a light metal (such as polycarbonate, a nylon resin, carbon fiber-reinforced resin (specific gravity: 1.5), or an aluminum alloy (specific gravity: 2.7)). The back member 4 is formed of a metal of a heaviest specific gravity (brass (specific gravity: 8.2), a tungsten-nickel alloy (specific gravity: 11.3), or the like). A hollow structure may be adopted without using the intermediate member 3. In this example, a relationship is adopted such that the specific gravity of the intermediate member 3<the specific gravity of the face member 2≦the specific gravity of the back member 4. It should be noted that the head width W and the depth of the center of gravity, ZGR, in FIG. 1 are lengths from a leading edge of a face surface 2A provided with a loft angle.

The face member 2 is formed of a material having a specific gravity of 2.7 to 8.0, and in addition to the aforementioned metal materials it is also possible to use such as duralumin, titanium, a titanium alloy, and maraging steel. The intermediate member 3 is formed of a material having a specific gravity of 0.9 to 3.0, and suitable for use as the aforementioned resin material are a nylon resin, an epoxy resin, a polycarbonate, ABS, BMC (bulk molding compound, which is preferable since its coefficient of contraction of the resin is low and its strength is high), SMC (sheet molding compound, which has a longer fiber length than BMC and has a higher strength), and the like. Furthermore, it is possible to suitably use as the intermediate member 3 a cloth fiber-reinforced resin (a fiber reinforced resin sheet formed into a cloth shape by weaving such as glass fibers or carbon fibers; if used in an outer layer, the mesh pattern is visible and is beautiful in terms of the outer appearance), a magnesium alloy (specific gravity: 1.7 to 2.0), an aluminum alloy (specific gravity: 2.7 to 2.8), and the like. The back member 4 is formed of a material having a specific gravity of 8.0 to 19.2, and in addition to the aforementioned materials it is possible to suitably use such as maraging steel (specific gravity 8.0), a copper alloy (specific gravity 8.2 to 8.6) such as brass or a beryllium-copper alloy, a tungsten-copper alloy, tungsten (specific gravity: 19.2), and the like.

In FIG. 1, reference numeral 5 denotes a hole in which a shaft not shown) is inserted and fixed, and reference numeral 2A denotes the face surface. A recessed portion may be provided in a ball striking portion of this face surface 2A, and a resin may be fitted or bonded therein. In addition, as for the intermediate portion 3, a metal having a light specific gravity such as an aluminum alloy or a ceramic should preferably be disposed to the sole surface to ensure that the sole surface is difficult to damage.

Figure 2:
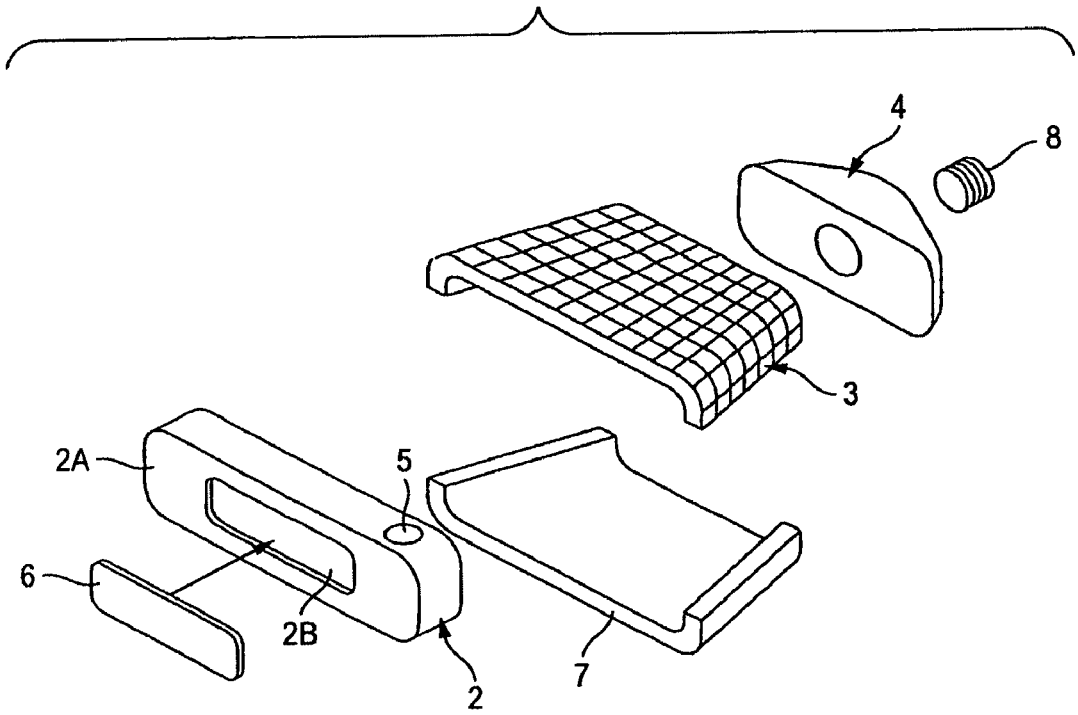
FIG. 2 is an exploded perspective view illustrating another embodiment.
Figure 3:
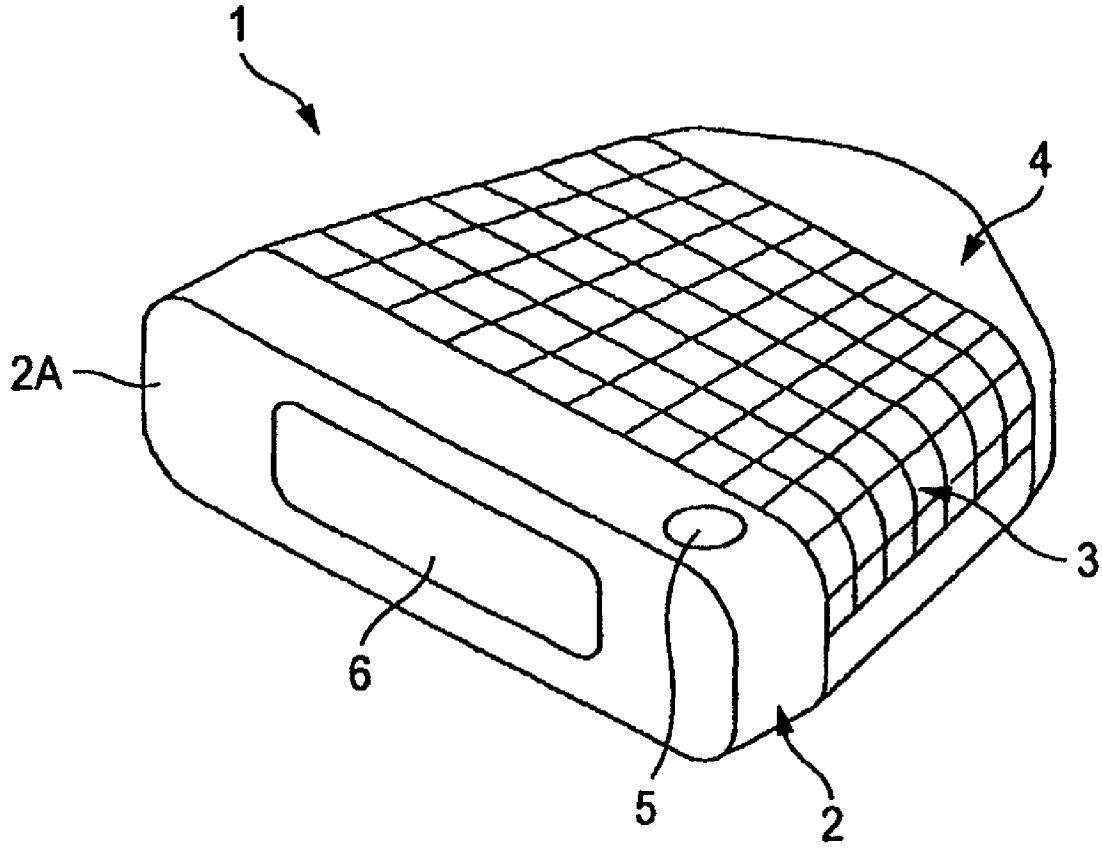
FIG. 3 is a plan view of a state in which the members shown in FIG. 2 are assembled.

FIG. 2 is an exploded perspective view illustrating another embodiment, in which a nylon resin-made ball striking plate 6 is fitted in a recessed portion 2B formed in the face surface 2A of the face member 2. Further, the intermediate member 3 located in the rear of the face member 2 is formed into an inverse U-shape with its lower side open by attaching a cloth fiber-reinforced resin sheet to the surface of BMC. An aluminum alloy-made sole portion 7 is attached to a lower side of this intermediate member 3. Furthermore, the back member 4 has its main body formed of stainless steel, and is formed by screwing a tungsten-nickel alloy-made screw 8 into this main body. FIG. 3 shows the putter head in which the members shown in FIG. 2 are assembled.

A putter head of a type which is a so-called "pin type" in terms of the shape of the putter head was set as Comparative Example 1 ((1) in the tables); a putter head of a type which is a so-called "mallet type" was set as Comparative Example 2 ((2) in the tables); and a putter head of the "2-ball type" of Callaway Golf Company (Odyssey white Hot 2-Ball Blade) was set as Comparative Example 3 ((3) in the tables). Various comparisons were made between these putter heads and two Examples A and B ((4) and (5) in the tables) of the invention. In Example A, an aluminum alloy was used as the face member, and SMC (carbon resin-reinforced resin) was used as the intermediate member, and a copper alloy was used as the back member. Example B is an example of FIG. 2.

TABLE 1

| | ZGR (mm) | IY ($g \cdot cm^2$) | Head Width W (mm) | Head Length L (mm) |
|---|---|---|---|---|
| (1) | 10.5 | 4100 | 29 | 115.0 |
| (2) | 25.0 | 3100 | 48 | 97.8 |
| (3) | 32.8 | 3520 | 86 | 98.1 |
| (4) | 42.0 | 4250 | 80 | 110.0 |
| (5) | 53.2 | 4750 | 95 | 118.0 |

As a result of conducting actual ball hitting tests using putters in which the respective putter heads shown in Table 1 were installed, the evaluation of the ease of swing is shown in Table 2, and the evaluation of the off-center hit performance is shown in Table 3. The off-center hit performance is based on the total evaluation of how the ball rolls and the directionality when the ball is hit off the sweet spot. In addition, the mark ◎ in the tables shows an evaluation that it is "very excellent;" the mark "○," it is "good;" the mark "Δ," it is "ordinary;" and the mark "x," it is "bad."

TABLE 2

| | Ease of Swing | | | | |
|---|---|---|---|---|---|
| | (1) | (2) | (3) | (4) | (5) |
| Professional A | Δ | ○ | ◎ | ◎ | ◎ |
| Professional A | x | Δ | ○ | ◎ | ◎ |
| Amateur C | Δ | Δ | ○ | ◎ | ◎ |
| Amateur D | ○ | Δ | ○ | ○ | ◎ |

TABLE 3

| | Off-center Hit Performance | | | | |
|---|---|---|---|---|---|
| | (1) | (2) | (3) | (4) | (5) |
| Professional A | ○ | x | Δ | ◎ | ◎ |
| Professional B | ○ | Δ | Δ | ◎ | ◎ |
| Amateur C | Δ | Δ | ○ | ◎ | ◎ |
| Amateur D | Δ | x | x | ◎ | ◎ |

In both Examples A and B, both of the deep center of gravity and the high moment of inertia were realized, and the putter heads were of shapes which do not present a strange feeling as compared with the conventional mallet-type putter. If the center of gravity becomes deep, the ease of swing and the stability of the stroke improve, and if the moment of inertia becomes large, the smash factor, i.e., the head speed/ball speed ratio, in off-center hits improves.

What is claimed is:

1. A putter head comprising:

a face member formed of a material having a specific gravity of 2.7 to 8.0;

an intermediate member formed of a material having a specific gravity of 0.9 to 3.0; and a back member formed of a material having a specific gravity of 8.0 to 19.2, wherein a moment of inertia, IY, about the center of gravity is such that $IY \geqq 4000\ g \cdot cm^2$, and a relationship between a head length L and a head width W is $0.7 \times L \leqq W \leqq L$, wherein the intermediate member includes an upper member and a sole member, the upper member and the sole member forming an opening with two ends, wherein one end of the opening is closed by face member, and the other end of the opening is closed by the back member.

2. A putter head according to claim 1, wherein the intermediate member is made of at least one of nylon resin, epoxy resin, polycarbonate, ABS, bulk-molding compound, sheet molding compound, cloth fiber-reinforced resin, magnesium alloy, and aluminum alloy.

3. A putter head according to claim 1, wherein the back member is made of at least one of maraging steel, copper alloy, beryllium-copper alloy, tungsten-copper alloy, and tungsten.

4. A putter head according to claim 1, further comprising a hitting plate, wherein the face member is made of titanium alloy and has a recess portion on the face side, and wherein the hitting plate is coupled to the recess portion.

5. A putter head according to claim 1, wherein a width of the intermediate member in a toe-heel direction is larger than a width of the back member in the toe-heel direction at least one point along a length of the intermediate member in a face-back direction.

6. A putter head according to claim 1, wherein IY is such that 5000 $g \cdot cm^2 \geqq IY$.

7. A putter head according to claim 1, wherein the upper member is made of bulkmolding compound.

8. A putter head according to claim 1, further comprising a screw member screwed into the back member, the screw member being made of tungsten-nickel alloy.

9. A putter head comprising:

a face member;

an intermediate member; and a back member having a back portion that is the farthest from the face member, wherein the face member, the intermediate member, and the back member are separately formed by respective members, wherein the intermediate member is interposed between the face member and the back portion, wherein the intermediate member includes an upper member and a sole member, the upper member and the sole member forming an opening with two ends, wherein one end of the opening is closed by face member, and the other end of the opening is closed by the back member, wherein a relationship in specific gravity among the respective members is such that the specific gravity of the intermediate member<the specific gravity of the face member≦the specific gravity of the back member, and that a moment of inertia, IY, about the center of gravity is such that $IY \geqq 4000\ g \cdot cm^2$.

10. The putter head according to claim 9, wherein a width of the intermediate member is larger than a width of the face member in a face-back direction.

11. A putter head according to claim 10, wherein the intermediate member is made of at least one of nylon resin, epoxy resin, polycarbonate, ABS, bulk-molding compound, sheet molding compound, cloth fiber-reinforced resin, magnesium alloy, and aluminum alloy.

12. A putter head according to claim 10, wherein the back member is made of at least one of maraging steel, copper alloy, beryllium-copper alloy, tungsten-copper alloy, and tungsten.

13. A putter head according to claim 10, further comprising a hitting plate, wherein the face member is made of titanium alloy and has a recess portion on the face side, and wherein the hitting plate is coupled to the recess portion.

* * * * *